US005924467A

United States Patent [19]

Allsopp

[11] Patent Number: 5,924,467

[45] Date of Patent: Jul. 20, 1999

[54] ASSEMBLY FOR CARRYING A LOUVRE IN A VERTICAL LOUVRE BLIND

[75] Inventor: Reginald Charles Allsopp, Stockport, United Kingdom

[73] Assignee: Louver-Lite Ltd, Hyde, United Kingdom

[21] Appl. No.: 09/023,108

[22] Filed: Feb. 13, 1998

[30] Foreign Application Priority Data

Feb. 14, 1997 [GB] United Kingdom ..... 9703138

[51] Int. Cl.[6] ..... E06B 9/38

[52] U.S. Cl. ..... 160/177 V; 160/900

[58] Field of Search ..... 160/177 V, 176.1 V, 160/168.1 V, 173 V, 172 V, 900

[56] References Cited

U.S. PATENT DOCUMENTS

| | | | |
|---|---|---|---|
| 4,193,438 | 3/1980 | Pastore . | |
| 4,335,775 | 6/1982 | Frentzel et al. | 160/177 V |
| 4,616,688 | 10/1986 | Agos . | |
| 4,664,191 | 5/1987 | Wyatt . | |
| 4,759,397 | 7/1988 | Walther | 160/177 V |
| 4,869,309 | 9/1989 | Evans . | |
| 4,967,823 | 11/1990 | Gagnon . | |
| 5,291,946 | 3/1994 | Ciriaci . | |

FOREIGN PATENT DOCUMENTS

| | | |
|---|---|---|
| 0120566A2 | 10/1984 | European Pat. Off. . |
| 0063265A2 | 10/1992 | European Pat. Off. . |
| 2293569 | 8/1976 | France . |
| 8400347 | 2/1984 | Netherlands . |
| 1550439 | 8/1979 | United Kingdom . |
| 2049003 | 12/1980 | United Kingdom . |
| 9109200 | 6/1991 | WIPO . |

*Primary Examiner*—David M. Purol
*Attorney, Agent, or Firm*—Dennison, Meserole, Scheiner & Schultz

[57] ABSTRACT

A connecting assembly for connecting a vertical louvre to a support and including a first component disposed within the support and a second component having a connection formation from which a louvre may be suspended. Each of the first and second components are releasably interconnected, such that the second component is retained in connection with the first component for use, and such that the second component is separable from the first component, and replaceable with a substitute component while the first component is mounted in the support member.

3 Claims, 2 Drawing Sheets

ASSEMBLY FOR CARRYING A LOUVRE IN A VERTICAL LOUVRE BLIND

BACKGROUND TO THE INVENTION

1. Field of the Invention

The present invention relates to assemblies for carrying louvres in vertical louvre blinds.

Vertical louvre blinds are commonly used to selectively obscure or uncover an aperture such as a window aperture. Such blinds comprise a plurality of elongate strip-like louvre elements, commonly of fabric, which hang from a headrail. Each louvre is attached the headrail by means of a carrier assembly. The blind also has an arrangement whereby the louvres may be gathered together at one or both end portions on the headrail (so withdrawing them from the aperture) or distributed along the headrail such that they are spaced apart across the aperture. Additionally, a typical vertical louvre blind comprises a drive arrangement, whereby the carrier assemblies can be caused to rotate the louvres about an axis (which axis is typically vertical) such that they can be selectively caused to lie substantially co-planar with one another, or such that each is in a respective spaced, parallel plane.

2. Summary of the Prior Art

In known vertical louvre blinds, each carrier assembly typically comprises a body which is formed to be slidably mountable on the headrail. A spigot is arranged to project from the body, the spigot having a connection formation, such as a hook, by which it may be connected to a louvre. Within the body is provided drive means in engagement with an inner portion of the spigot by which the spigot may be rotated about an axis so as to cause rotation of a louvre attached to it. The carrier assemblies are mechanically quite complex and as such are best suited to factory assembly, whereas each blind will normally be assembled by a retail distributor using factory-made components.

It is known that, from time to time, the connection formation of a spigot may break. For example, if one of the louvres is pulled sharply from the blind such a breakage. could occur. Although this may not be a particularly common occurrence, it is extremely inconvenient. In a conventional blind, the entire carrier assembly on which the breakage occurred must typically be replaced. This involves removing the blind from its mounting, following which the carrier assemblies must be removed one-by-one from the headrail until the broken one can be removed and replaced. The entire procedure must then be reversed to re-instate the blind. This is a time-consuming procedure which can often cause inconvenience to the owner of the blind.

A further disadvantage with conventional louvre blinds is that there is often a need to provide a blind manufacturer with a range of carrier assemblies having a variety of different connection formations, so that a range of different types of louvre can be used. With the above-described, conventional arrangement, this means that a variety of different carrier assemblies must be manufactured.

SUMMARY OF THE INVENTION

An aim of the present invention is to facilitate repair of a blind which has failed through breakage of a connection formation. A further aim of the invention is to provide greater convenience for manufacturers and stockists of components of louvre blinds.

According to a first aspect of the invention there is provided a carrier assembly for connecting a louvre to a support member in a vertical louvre blind, the carrier assembly comprising a body adapted to be slidably mounted in a supporting member, and a connecting assembly, which connecting assembly comprises a first component disposed within the body and a second component at least part of which projects from the body and which has a connection formation from which a louvre may be suspended, each of the first and second components having mutually interengageable formations by means of which they may be releasably interconnected, such that the second component is retained in connection with the first component for use, and such that the second component is separable from the first component, and replaceable with a substitute component while the body is slidably mounted in a supporting member.

By this arrangement, in the event that the connection formation of a connecting assembly should fail, the second component of the connecting assembly may be replaced without the need to remove the carrier assembly from the blind. A further advantage which arises is that carrier assemblies may be factory assembled without the second component of the connecting assembly, the second component being provided only as and when demanded for a particular blind.

Within the body, a mechanical arrangement is provided by means of which the connecting assembly can be rotated about an axis under the action of an external drive means. Thus, the mutually interengageable formations of the first and second components most preferably are adapted to resist rotation of the first and second components with respect to each other, in order that said axial rotation can be transmitted to a louvre attached to the connection assembly.

In a preferred embodiment, the first component has a bore into which a securing portion of the second component is inserted and retained. Co-operating formations may be provided in the bore and on the securing portion to retain, in interconnection the first and second components. Such formations may include one or more projections on the securing portion.

In a particularly preferred arrangement, the securing portion of the second component carries projections which engage with a step in a bore of the first component, the securing portion being resiliently deformable, such that the projections can be displaced sufficiently to allow the securing position to be inserted into the securing portion, and to spring back into an undisplaced condition to secure the second component in place with the first component.

It has been found to be advantageous to arrange for the first and second components to be separable by causing the second component to rotate with respect to the first component. In embodiments according to the last-preceding paragraph, such mutual rotation causes resilient deflection of the projections such that they are no longer retained by the step. It is highly preferable that the torque required to cause such mutual rotation of the first and second component is substantially greater than will be encountered in order to rotate the louvres in normal use.

DESCRIPTION OF THE PREFERRED EMBODIMENT

A preferred exemplary embodiment of the present invention will now be described in detail with reference to the accompanying drawings.

For convenience, the features of this embodiment will be described and are illustrated in the orientation which they adopt in a vertical louvre blind mounted on a horizontal downwardly facing surface. In particular, terms such as 'top', 'bottom', 'up', 'down' and 'side' should be understood as applying to components of a blind mounted in the above-described manner.

Figure 1:
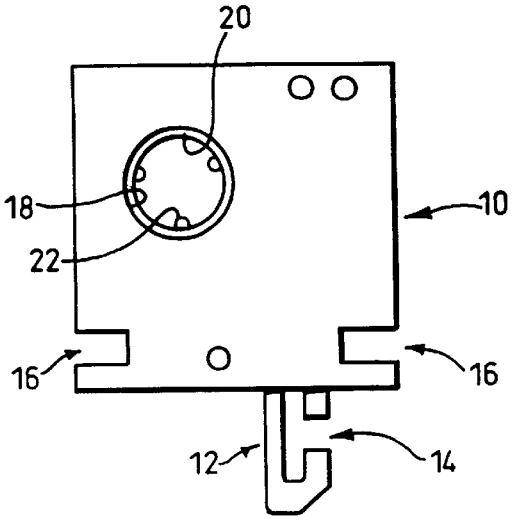
FIG. 1 is a side view of a carrier assembly for a vertical louvre blind embodying the invention.
Figure 2:
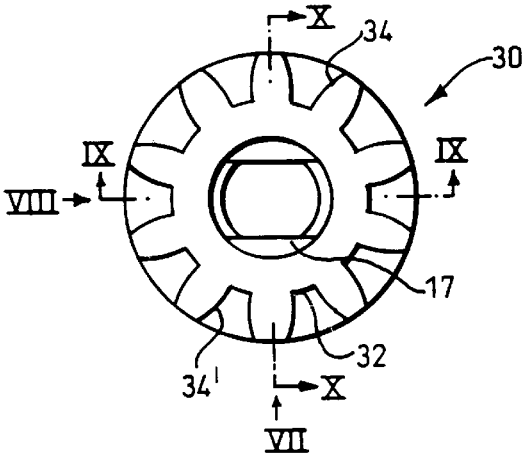
FIG. 2 is a plan view of a first component of a connection assembly of the carrier assembly of FIG. 1.
Figure 5:
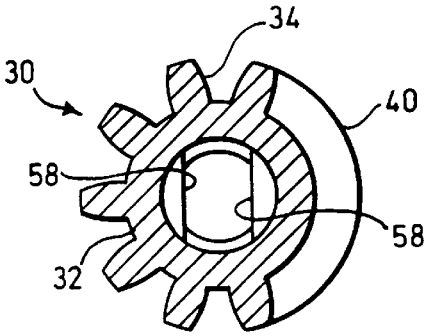
FIG. 5 is a sectional view along line III—III of FIG. 6.

Making brief reference to FIG. 1, a carrier assembly for a vertical louvre blind embodying the invention comprises a body 10 from which a spigot 12 projects generally along a vertical axis through a hole (not shown) in a lower wall of the body 10. The spigot 12 comprises a hook 14 which constitutes a connection formation by means of which a louvre can be connected to the spigot 12. The body (which, in this embodiment, is of conventional design) has side walls into which a pair of slots 16 extend. For use, the body 12 is disposed on an elongate headrail, which is also conventional in this embodiment. The headrail has a pair of fins extending along its length, a portion of each respecting fin being received into one of the slots 16, whereby the body is retained by the headrail such that the body 10 may slide axially along the headrail.

A respective through hole 18 is provided in each of two opposite walls of the body 10, the through holes 18 being aligned to provided an aperture through the body 10, which aperture has an axis substantially aligned with the axis along which the body 10 may slide with respect to the headrail. Within the body, a wheel 20 is mounted for rotation about the axis of the aperture. An outer surface, (not shown) of the wheel is formed as a worm gear, which is operatively connected to the spigot 12, such that rotation of the wheel about the axis of the aperture causes rotation of the spigot about its axis, these respective axes being substantially perpendicular to one another.

The wheel 20 has a central through hole into which a plurality of projections 22 extend radially. In an assembled blind, a rod extends through the wheels 20 of each of a multiplicity of carrier assemblies mounted on a common headrail. The rod has formations which engage with the projections 22 such that rotation of the rod causes corresponding rotation of the wheel. Thus, by providing suitable controls by means of which the rod can be rotated by a user, the spigots 12, and louvres attached to them, can be rotated under the control of a user. Further controls are provided by means of which the carrier assemblies can be displaced along the headrail under the control of a user, as is well-known to those familiar with vertical louvre blinds.

The spigot 12 is part of a connecting assembly, which assembly will now be described in detail.

Figure 3:
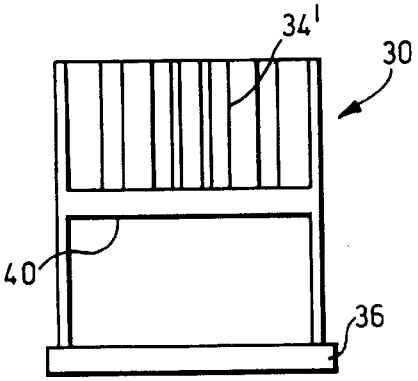
FIG. 3 is a side view of the first component of FIG. 2.
Figure 6:
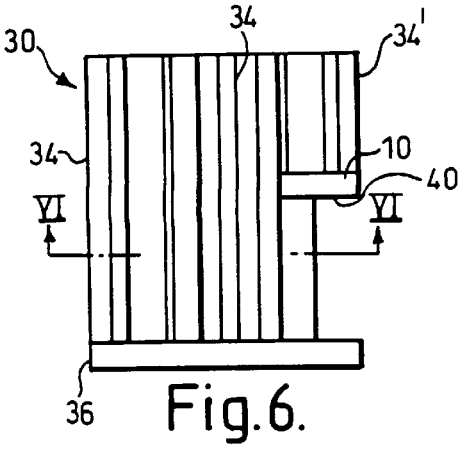
FIG. 6 is a side view of the first component of FIG. 2, the view being at right angles to that of FIG. 3.
Figure 4:
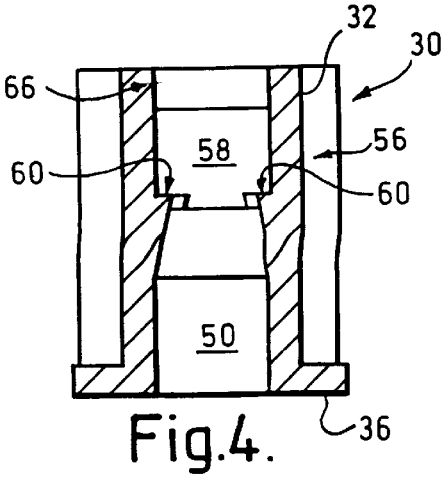
FIG. 4 is a section along line VI—VI of FIG. 2.
Figure 7:
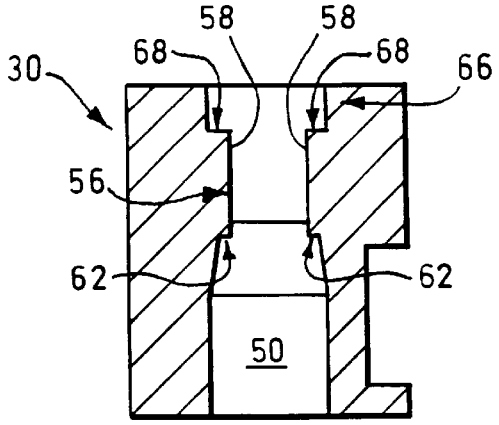
FIG. 7 is a section along IX—IX in FIG. 2.
Figure 8:
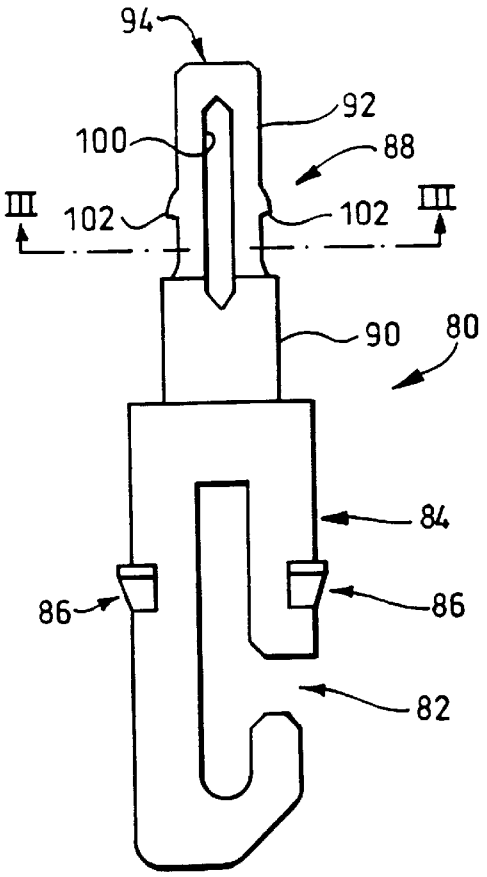
FIG. 8 is a side view of a second component of a connection assembly of the carrier assembly of FIG. 1.
Figure 9:
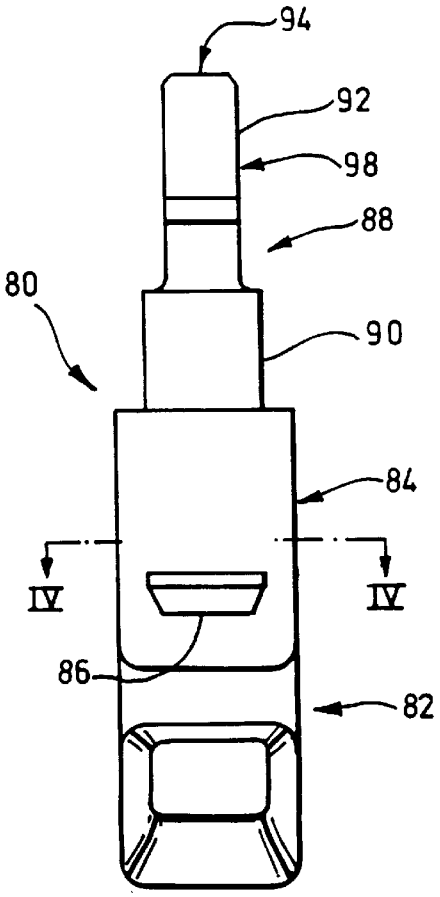
FIG. 9 is a front view of the second component of FIG. 8.
Figure 10:
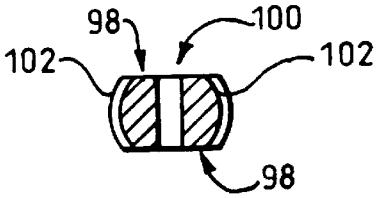
FIG. 10 is a sectional view along line III—III of FIG. 9.
Figure 11:
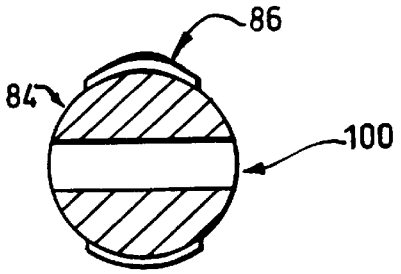
FIG. 11 is a sectional view along line IV—IV of FIG. 9.

A first component 30 of the connecting assembly is located within the body 10 such that it may rotate about an axis which is coaxial with the axis of rotation of the spigot 12. In normal use, the first component 30 is disposed in an orientation as shown in FIGS. 3 and 6.

The first component 30 is a unitary injection moulding. It is formed around a cylindrical core 32 through which an axial bore extends. A plurality of circumferentially-spaced teeth 34 project radially from the core 32.

At a lower end region of the first component 30, there is provided an annular formation 36, which extends radially outwardly to a distance equal to that which the teeth 34 project. The annular formation has a circular peripheral shape, centred upon the axis of the first component 30.

A first plurality of adjacent teeth 34 extend from an upper end of the first component 30 to end at the annular formation. The remainder of the teeth (designated 34') are foreshortened, extending from the upper end of the first component 30 to end approximately half-way to the annular component. A laminar projection 40 extends radially from the core 32 in a plane normal to the axis of the first component 30 to interconnect lower ends of the foreshortened teeth 34'.

The teeth 34 are spaced and shaped such that they can coact with the worm gear formed on the wheel 20 of the carrier assembly, whereby rotation of the wheel 20 about a horizontal axis causes rotation of the first component 30 about a vertical axis. The extent of rotation of the first component 30 is limited by the presence of the foreshortened teeth 34' and the laminar projection 40. As rotation proceeds, an end of the worm gear will eventually enter between an adjacent pair of foreshortened teeth 34'. The end of the worm gear will then make contact with the laminar projection 40, whereupon further movement will be prevented. This happens during rotation in both directions, so causing the extent of rotation to be limited between two extremes.

As stated above, the core 32 has a bore which extends axially through it. The bore has a plurality of discrete regions. These will now be described in detail, with reference in particular to FIGS. 2, 4, 5 and 7.

A lowermost portion 50 of the bore is cylindrical. Adjacent the lowermost portion 50, the bore has a tapering portion 52. The tapering portion 52 is of circular cross-section other than at an upper extreme end region, which will be described below. At its interconnection with the lowermost portion 50, the tapering portion 52 is of diameter equal to that of the lowermost portion 50, the diameter of the tapering portion 52 decreasing in an upward direction.

Upwardly of the tapering portion 52, an intermediate region 56 of the bore has a cross-section shaped as a circle having two inwardly-projecting flats 58, each formed as a sector of a circle, the flats being diametrically opposed to and parallel with one another.

The intermediate portion is dimensioned such that the distance between its flats 58 is less than the diameter of the extreme upper end region of the tapering portion 52, but such that its diameter in regions devoid of flats 58 is greater than the diameter of the extreme upper end region of the tapering portion 52. At the extreme upper end region of the tapering portion 52, at its intersection with the intermediate portion 56, there is formed a pair of upwardly-directed steps 60 and a pair of downwardly-directed steps 62 in the bore.

An upper end portion 66 of the bore is of circular cross-section, of diameter equal to that of the intermediate portion 56 in the region devoid of flats. Thus, the flats 58 each presents a sector-shaped projection having an upwardly-directed surface 68 facing into the upper end portion of the bore.

A second component 80 of the spigot is shown in FIGS. 8 to 11.

The second component 80 is formed a unitary moulding of plastics material. The second component 80 includes a lower portion, part of which constitutes the spigot 12, and which incorporates a connection formation this being a region of the lower portion 82 in which is formed the hook 14. The particular shape and size of the hook is selected to be compatible with a louvre which is intended to be attached to it. In the region of the connection formation 82, the second component has a generally circular cross-section, having a cylindrically-curved outer surface 84.

A pair of diametrically opposed projections 86 project from the curved outer surface 84 from approximately mid-way from its lower end. Each projection 86 has an arcuate profile when viewed in plan which has a centre common with a centre of the connection formation 82. A lower surface of each projection 86 is angled to extend outwardly and upwardly, while an upper surface is substantially horizontal.

A securing portion 88 of the second component extends coaxially upwardly from the lower portion. The securing portion 88 has a lower section 90 which is cylindrical, and which extends upwardly from the lower portion. The securing portion 88 also has an upper section 92 which extends upwardly from the lower section 90 to end in an upwardly directed free end face 94. The upper section 92 has a cross-sectional shape which is generally of a circular outline into which two diametrically opposed flats have been cut, whereby to form a pair of outwardly-directed flat faces 98.

A slot 100 extends though the securing portion. The slot 100 is oriented to be normal to the flat faces 98, and extends from a short distance into the lower section 90, upwardly to approach, but stop short of, the free end face 94.

At a height approximately mid-way up the slot, a pair of projections 102 extend radially from the upper section 92. Each projection extends around a respective curved portion of the outer surface of the upper section 92 intermediate the flat faces 98. Each projection has a lower face which extends horizontally to present a flat, downwardly-directed surface, and a sloping upper face which slopes radially inwardly in an upward direction.

In construction of a carrier assembly (disregarding assembly of components not being part of the spigot) the first component 30 is first placed in the body 10, in contact with the lower wall of the body, and with its axis aligned with the hole in the lower wall. Within the body 10, suitable formations are provided to retain the first component in place. The wheel 20 and any other components of the body are assembled, as required.

Subsequently, as required, the carrier assembly can be completed by insertion of the securing portion 88 of the second component 80 into the bore of the first component 30 through the hole in the lower wall of the body. The second component 80 can be inserted readily only when it is rotated such that its flat faces 98 align with the flats 58 of the first component 30. This ensures that the hook 82 (and therefore a louvre attached to it) is in alignment with all other hooks in a blind.

The second component 80 is then urged axially into engagement with the first component 30. The sloping faces of the projections 102 of the upper section 92 engage with walls of the tapering portion 52 and act to transversely compress the upper section 92, this compression being made possible by the presence of the slot, the material of the upper part 92 being deflected elastically inwardly to occupy the space made available within the slot 100. During subsequent movement, the projections 102 slide along the wall of the intermediate region 56

When the second component 80 has been thus inserted sufficiently far that the projections 102 move past the intermediate region 56 into the upper end portion 66 of the bore. The projections 102 are then free to move outwardly under the resilient action of the material of the second component 80. Withdrawal of the second component 80 from the first component 30 is then strongly resisted by interengagement of the lower surfaces of the projections 102 with the upper surfaces of the flats 58. The first and second components are so dimensioned such that, when the projections 102 move into the upper end portion 66, the upper surfaces of the projections 86 of the lower portion of the second component approach closely the lower wall of the body 10. Thus, both upward and downward movement of the second component 80 with respect to the body 10 is closely limited.

If it should happen that the second component 80 should fail in the region of the hook 82, it may be replaced by proceeding as follows. A part of the second component 80 which projects from the body 10 is grasped firmly. The second component 80 is then forced to rotate by substantially 90°. It should be noted that the torque required to do this is very much greater than would ever be encountered during normal operation of the blind. The effect of this is to cause the flats 58 to compress the upper section 92, through elastic deflection of the material of the upper part 92 into the slot 100. The second component 80 can the be withdrawn from the body 10, and replaced with another identical, but unbroken, component.

What is claimed is:

1. A carrier assembly for connecting a louvre to a support member in a vertical louvre blind, the carrier assembly comprising:

a body adapted to be slidably mounted in the support member, and a connecting assembly in which the connecting assembly comprises:

a first component disposed within the body, the first component having a bore;

and a second component at least part of which projects from the body and which has a connection formation from which a louvre may be suspended, and which has a securing portion which can be inserted and retained within the bore of the first component, the securing portion carrying projections which engage with an inwardly directed step in the bore, the securing portion being resiliently deformable such that the projections can be displaced sufficiently to allow the securing portion to be inserted into the bore with the projection inward of the step, and then to spring back into an undeformed condition to engage the projections on the step and retain the second component with the first component for controlled movement therewith, the second component being separable from the first component for replacement with a substitute component while the body is slidably mounted in the support member, and wherein the second component is rotatable within the first component with cooperating means in said bore and on said securing portion for resilient deflection of the projections in response to rotation of said second component with respect to the first component to release the engaged projections and permit removal of the securing portion from the bore.

2. A carrier assembly according to claim 1 including means for rotating said first component, means for rotatably fixing said second component to said first component for rotation of said second component with said first component upon rotation of said first component and the development of a torque therebetween, said cooperating means in said bore and on said securing portion allowing release of said first component from said second component upon a relative fixing of said first component and a rotation of said second component relative to said first component at a torque substantially greater than said first mentioned torque.

3. A carrier assembly according to claim 1 wherein said securing portion has a pair of opposed flat faces and a pair of opposed arcuate faces between said flat faces, said securing portion having a first dimension between said flat faces and a second greater dimension between said arcuate faces, said bore having corresponding flat and arcuate faces, said flat faces of said securing portion and said bore, when in face-to-face engagement, defining said means for rotatably fixing said second component to said first component, said arcuate faces of said securing portion and said flat faces of said bore defining said cooperating means for resilient deflection of the projections in response to relative rotation of said second component wherein release of the engaged projections is achieved.

* * * * *